US006167779B1

(12) United States Patent
Sano et al.

(10) Patent No.: US 6,167,779 B1
(45) Date of Patent: Jan. 2, 2001

(54) CAR INSIDE HANDLE UNIT STRUCTURE

(75) Inventors: Takayuki Sano; Ryuji Minemura, both of Kanagawa-ken (JP)

(73) Assignees: Nissan Motor Co., Ltd.; Alpha Corporation, both of Kanagawa-Ken (JP)

( * ) Notice: Under 35 U.S.C. 154(b), the term of this patent shall be extended for 0 days.

(21) Appl. No.: 09/317,149

(22) Filed: May 24, 1999

(30) Foreign Application Priority Data

May 22, 1998 (JP) ..... 10-141577

(51) Int. Cl.[7] ..... E05B 3/00
(52) U.S. Cl. ..... 74/543; 292/336.3
(58) Field of Search ..... 74/523, 526, 543, 74/548; 16/266; 292/336.3

(56) References Cited

U.S. PATENT DOCUMENTS

| | | | | |
|---|---|---|---|---|
| 1,602,754 | * | 10/1926 | Delbridge | 16/266 |
| 2,011,675 | * | 8/1935 | Cawood | 16/266 |
| 2,555,473 | * | 6/1951 | Deaton | 16/266 |
| 3,424,510 | * | 1/1969 | Moon | 16/266 |
| 3,471,874 | * | 10/1969 | Dixon | 16/266 |
| 3,610,460 | * | 10/1971 | Siklos et al. | 16/266 |
| 5,038,437 | * | 8/1991 | Russell et al. | 16/266 |
| 5,522,279 | * | 6/1996 | Kataumi | 74/523 |
| 5,651,163 | * | 7/1997 | Tamaki | 74/543 |
| 5,791,703 | * | 8/1998 | Kritzler et al. | 292/336.3 |
| 5,794,994 | * | 8/1998 | Miyagawa et al. | 292/336.3 |
| 5,895,081 | * | 4/1999 | Tanimoto et al. | 292/336.3 |
| 6,003,204 | * | 8/1998 | Roach et al. | 16/266 |

FOREIGN PATENT DOCUMENTS

| | | | |
|---|---|---|---|
| 6-7196 | | 2/1994 | (JP) . |
| 8-294651 | * | 11/1996 | (JP) . |

* cited by examiner

*Primary Examiner*—David A. Bucci
*Assistant Examiner*—Chong H. Kim
(74) *Attorney, Agent, or Firm*—McDermott, Will & Emery

(57) ABSTRACT

Boss axes are provided to a pair of supporting walls, which are opposed to each other, on a base to project therefrom. Flat surfaces of the boss axes are tilted relative to a center line of the groove in a latching position such that a releasing direction of a handle in a releasing position is positioned on an opposite side to an operating portion positioned in the latching position. Accordingly, overlapping lengths between circular arc surfaces of the boss axes in the unlatching position and the partial inner peripheral surface of the bearing hole can be increased. Therefore, a surface pressure applied to the boss axes of the base can be reduced in the unlatching position and thus the handle supporting strength can be improved.

12 Claims, 9 Drawing Sheets

CAR INSIDE HANDLE UNIT STRUCTURE

The content of Application No.TOKUGANHEI 10-141577, filed on May 22, 1998 in Japan is hereby incorporated by reference.

BACKGROUND OF THE INVENTION

The present invention relates to a car inside handle unit structure.

As an example of the related art, the car inside handle unit structure is set forth in Utility Model Application Publication (KOKOKU) Hei 6-7196.

SUMMARY OF THE INVENTION

In the car inside handle unit structure in the related art, to increase an overlapping length between a bearing hole of a handle and boss axes of a base is limited. Therefore, in order to enhance a handle supporting strength of a base, change of material is needed, for example, costly polycarbonate material, etc. must be utilized.

It is an object of the present invention to provide a car inside handle unit structure which is able to enhance the handle supporting strength without change of material.

In order to achieve the above object, a car inside handle unit structure of the present invention comprises a handle, a base, an energizing member, and a stopper. The handle has a coupling portion and an operating portion extended from the coupling portion. The coupling portion has a pair of opposing end walls each of which has a bearing hole and a groove. The groove extends from the bearing hole in a direction opposite to the operating portion to open the bearing hole. The base is fixed to a car body and has a base plate and a pair of supporting walls which project from the base plate to oppose to each other. The supporting walls have a pair of boss axes which project from the supporting walls to oppose to each other. The boss axes are inserted into the bearing holes respectively to support the handle rotatably from a releasing position to a latching position via an unlatching position. The operating portion is positioned in substantially parallel with the base plate in the latching position, and stands upright in the base plate in the unlatching position. Each of the boss axes has an outer peripheral surface consisting of a pair of flat surfaces positioned in parallel and circular arc surfaces formed between the flat surfaces. Both the circular arc surfaces come into contact with a partial inner peripheral surface between the latching position and the unlatching position. When the handle is positioned in the releasing position, only one of the circular arc surfaces comes into contact with the partial inner peripheral surface of the bearing hole and also the flat surfaces allows the boss axis to pass through the groove. The boss axis is inserted/pulled out into/from the bearing hole through the groove. The flat surfaces being tilted from a vertical direction of the base plate to a side which is opposite to an extending direction of the operating portion positioned in the latching position. The energizing member is positioned to expand between the base and the handle, and energizes the handle toward the latching position. The stopper is fitted attachably/detachably to the base to prevent the handle from turning to the releasing position via the unlatching position.

According to the above configuration, since the flat surfaces of the boss axes are tilted from the vertical direction of the base plate to the side which is opposite to the extending direction of the operating portion positioned in the latching position, contact areas between circular arc surfaces of the boss axes in the unlatching position and the partial inner peripheral surface of the bearing hole can be increased. Therefore, when the handle is positioned in the unlatching position, a surface pressure applied to the boss axes of the base can be reduced and thus the handle can be supported firmly.

DESCRIPTION OF THE PREFERRED EMBODIMENT

A car inside handle unit structure according to an embodiment of the present invention will be explained with reference to the accompanying drawings hereinafter.

Figure 1:
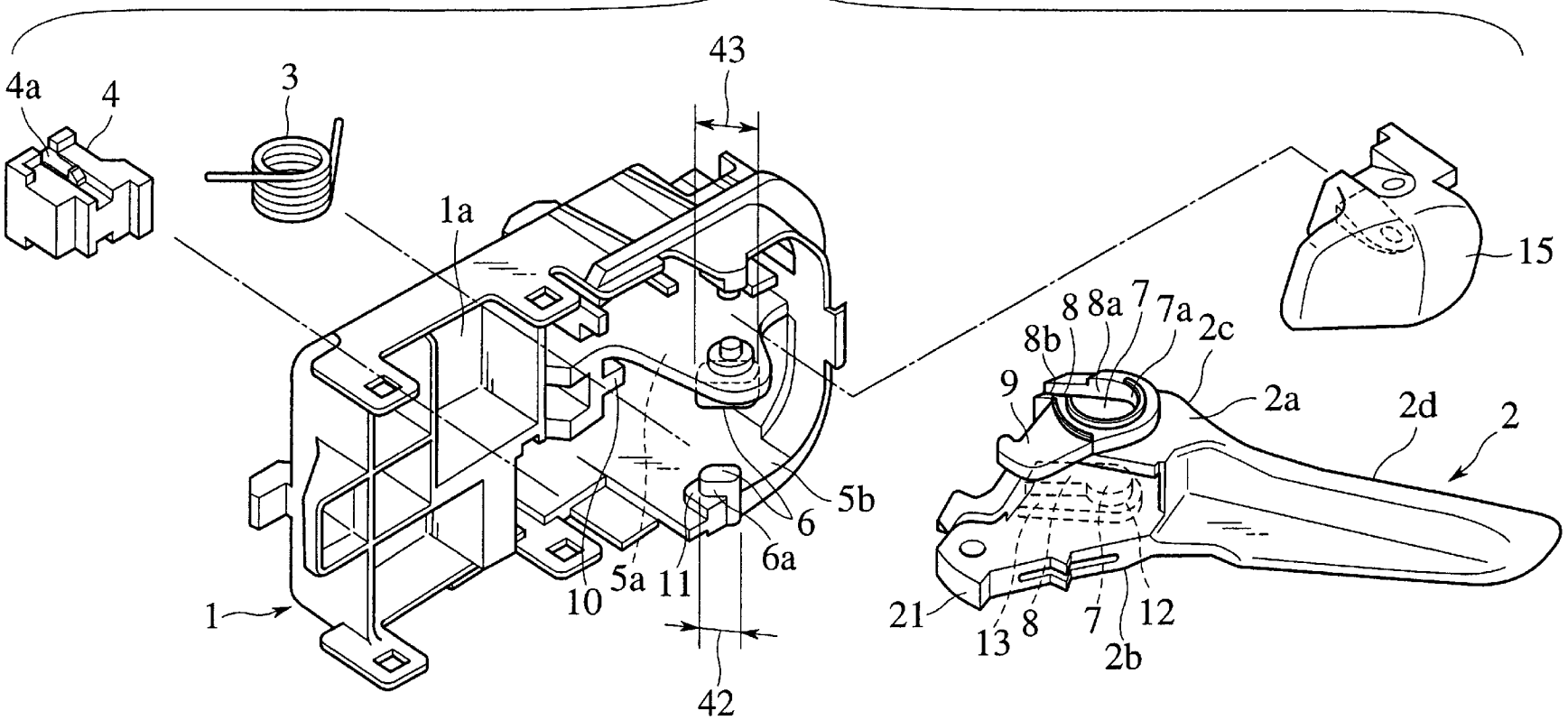
FIG. 1 is an exploded perspective view showing a car inside handle unit structure according to an embodiment of the present invention.
Figure 2:
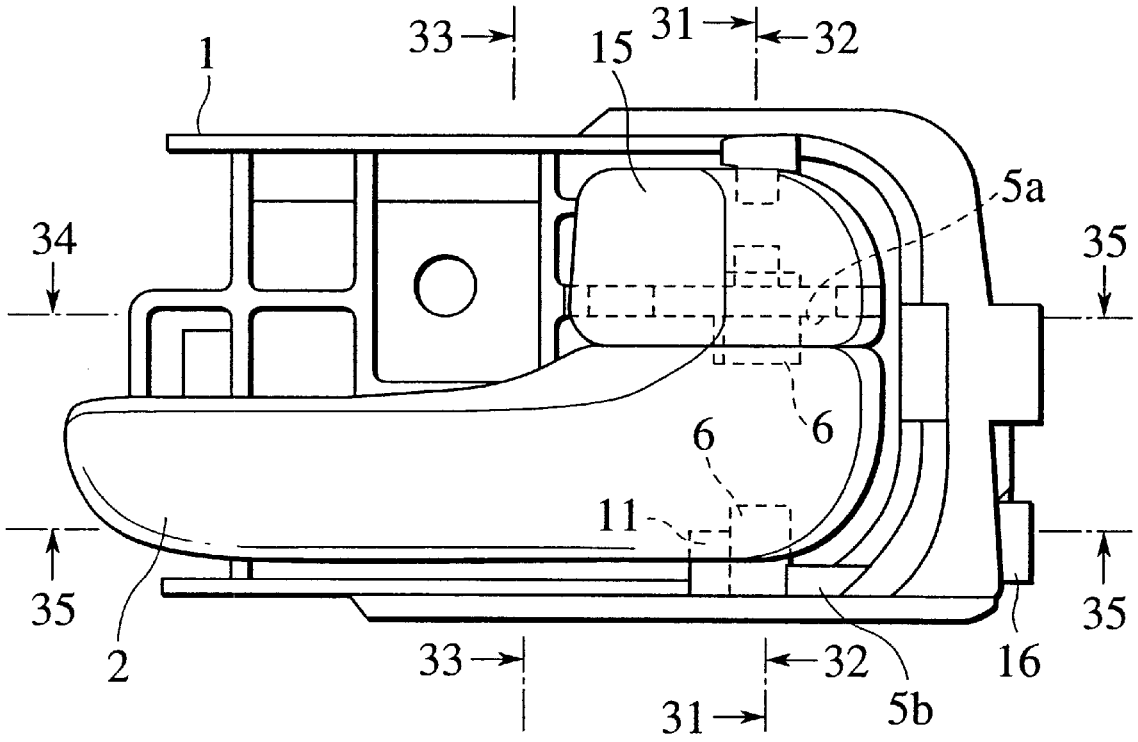
FIG. 2 is a side view showing the car inside handle unit structure in FIG. 1.

As shown in FIG. 1, a base 1 which is secured onto a car body has a base plate la and a handle receiving portion 5. A pair of walls, i.e., an upper wall 5*a* and a lower wall 5*b* which are provided in parallel so as to project from the base plate la as supporting walls are provided to the handle receiving portion 5. Boss axes 6, 6 are projected from inner surfaces of the upper wall 5*a* and the lower wall 5*b* respectively so as to oppose to each other. A handle 2 which is turned by an operator is inserted between the upper wall 5*a* and the lower wall 5*b*.

Figure 7:
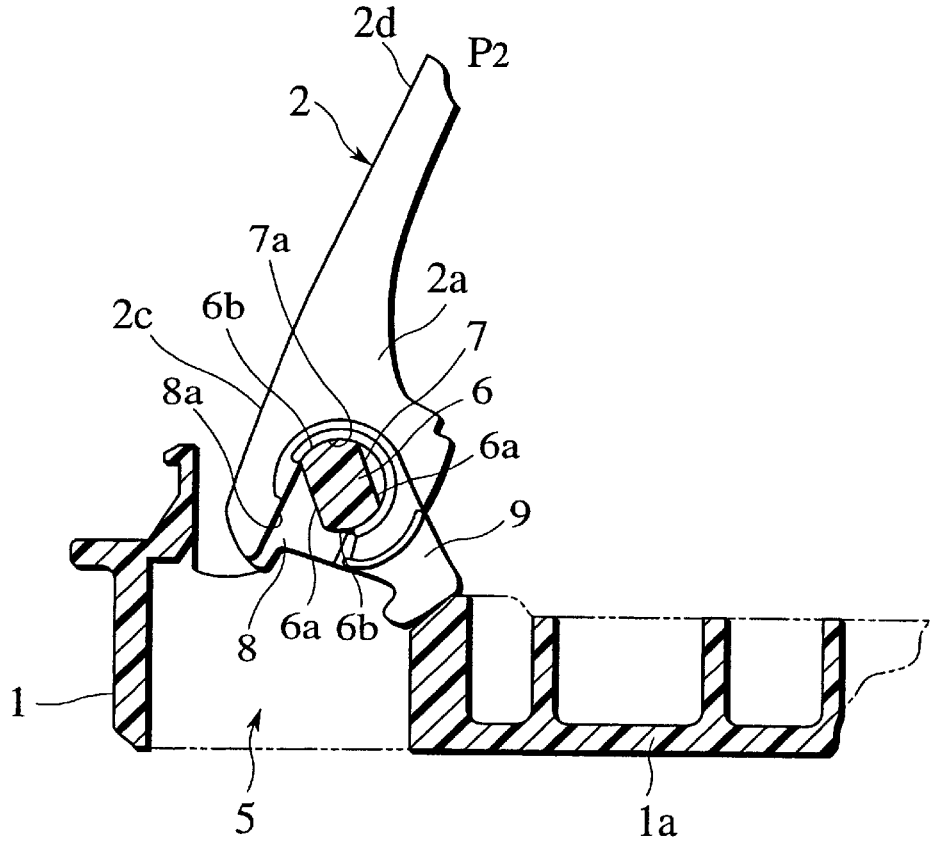
FIG. 7 is a sectional view, taken along the line 34—34 in FIG. 2, showing the car inside handle unit structure positioned in the unlatching position.
Figure 8:
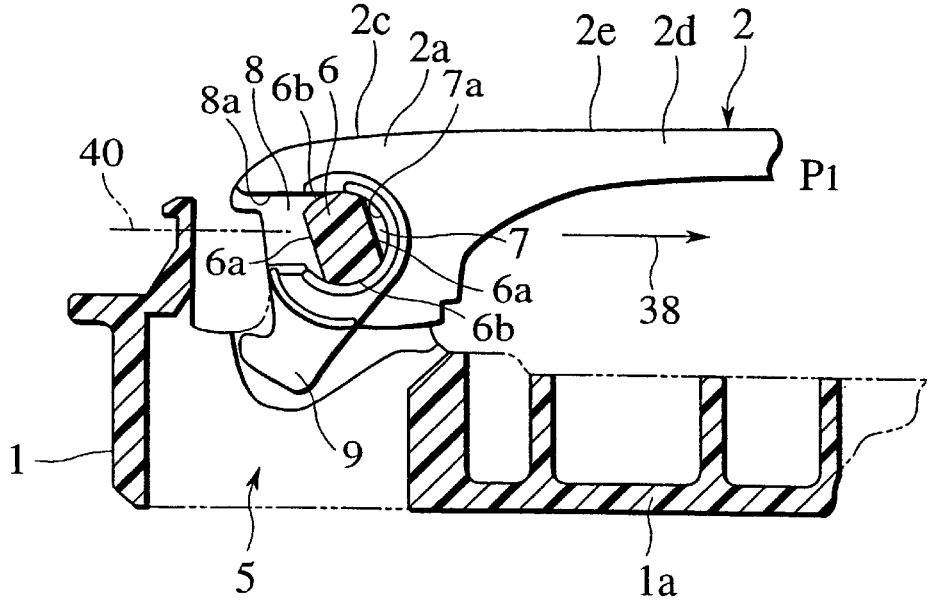
FIG. 8 is a sectional view, taken along the line 34—34 in FIG. 2, showing the car inside handle unit structure positioned in the latching position.

The handle 2 consists of a coupling portion 2*c* which is partially contained in the handle receiving portion 5 and an operating portion 2*d* extending from the coupling portion 2*c*. A pair of end walls, i.e., an upper end wall 2*a* and a lower end wall 2*b* which are provided in parallel so as to oppose to the upper wall 5*a* and the lower wall 5*b* respectively are provided to the coupling portion 2*c*. Bearing holes 7, 7 are formed in the end walls 2*a*, 2*b* respectively. The end walls 2*a*, 2*b* are inserted between the upper and lower walls 5*a*, 5*b*, and the boss axes 6, 6 are passed through the bearing holes 7, 7. Under such situation, the handle 2 can be supported rotatably by the boss axes 6, 6, and can be shifted from a releasing position P3 (see FIG. 10) to an unlatching position P2 (see FIG. 7) via a latching position P1 (see FIG. 8). As shown in FIG. 8, the operating portion 2*d* is positioned in the latching position P1 in substantially parallel to the base plate 1*a* to expose an outer surface 2*e* of the handle 2. As shown in FIG. 7, the operating portion 2*d* is separated from the base plate 1*a* in the unlatching position P2 to stand upright in the base plate 1*a*.

A coil spring 3 serving as an energizing member is positioned to expand between the base 1 and the handle 2, and energizes the handle 2 toward the latching position P1.

A stopper 4 can be fitted to the base 1 attachably/detachably by latching a pawl portion 4*a*. As indicated by a virtual line in FIG. 11, since a projected end 21 of the coupling portion 2*c* of the handle 2 is engaged with the stopper 4, the handle 2 can be prevented from moving to the releasing position P3 via the unlatching position P2.

Shifting of the handle 2 to the releasing position P3 can be prevented by installing the stopper 4 onto the base 1 after the handle 2 has been fitted onto the base 1, so that the handle 2 can be prevented from being disconnected from the base 1.

Each of the boss axes 6, 6 has a peripheral surface consisting of a pair of flat surfaces 6*a*, 6*a* which are formed in parallel with the releasing direction 36 (see FIG. 6) of the handle 2, and circular arc surfaces 6*b*, 6*b* which connect edges of the flat surfaces 6*a*, 6*a* respectively. The circular arc surfaces 6*b*, 6*b* constitute a part of one virtual circular peripheral surface 37 (see FIG. 6).

The bearing holes 7, 7 and grooves 8, 8 are formed in the upper and lower end walls 2*a*, 2*b* of the handle 2 respectively. Each of the bearing holes 7, 7 is partitioned by a partial inner peripheral surface 7*a*. The partial inner peripheral surface 7*a* has an inner diameter which is substantially equal to an outer diameter of the virtual circular peripheral surface 37. When the boss axis 6 is inserted into the bearing holes 7, 7, the partial inner peripheral surfaces 7*a*, 7*a* come into contact with the circular arc surfaces 6*b*, 6*b* slidably.

The groove 8 extends from the bearing hole 7 in the opposite direction to the operating portion 2*d* to open the bearing hole 7. The groove 8 is partitioned by a pair of inner surfaces 8*a*, 8*b* which are opposed in parallel with each other. A distance between the inner surfaces 8*a*, 8*b* is set slightly larger than a distance between the flat surfaces 6*a*, 6*a* of the boss axis 6. Therefore, when the flat surfaces 6*a*, 6*a* are positioned in almost parallel with the inner surfaces 8*a*, 8*b*, the boss axis 6 can be moved relatively along the groove 8. The boss axis 6 can be inserted/released into/from the bearing hole 7 by moving the boss axis 6 relatively along the groove 8 to thus attach/detach the handle 2 to/from the base 1.

Both the circular arc surfaces 6*b*, 6*b* of the boss axis 6 come into contact with the partial inner peripheral surface 7*a* of the bearing hole 7 between the latching position P1 and the unlatching position P2. Only one of the circular arc surfaces 6*b*, 6*b* comes into contact with the partial inner peripheral surface 7*a* in the releasing position P3.

Figure 6:
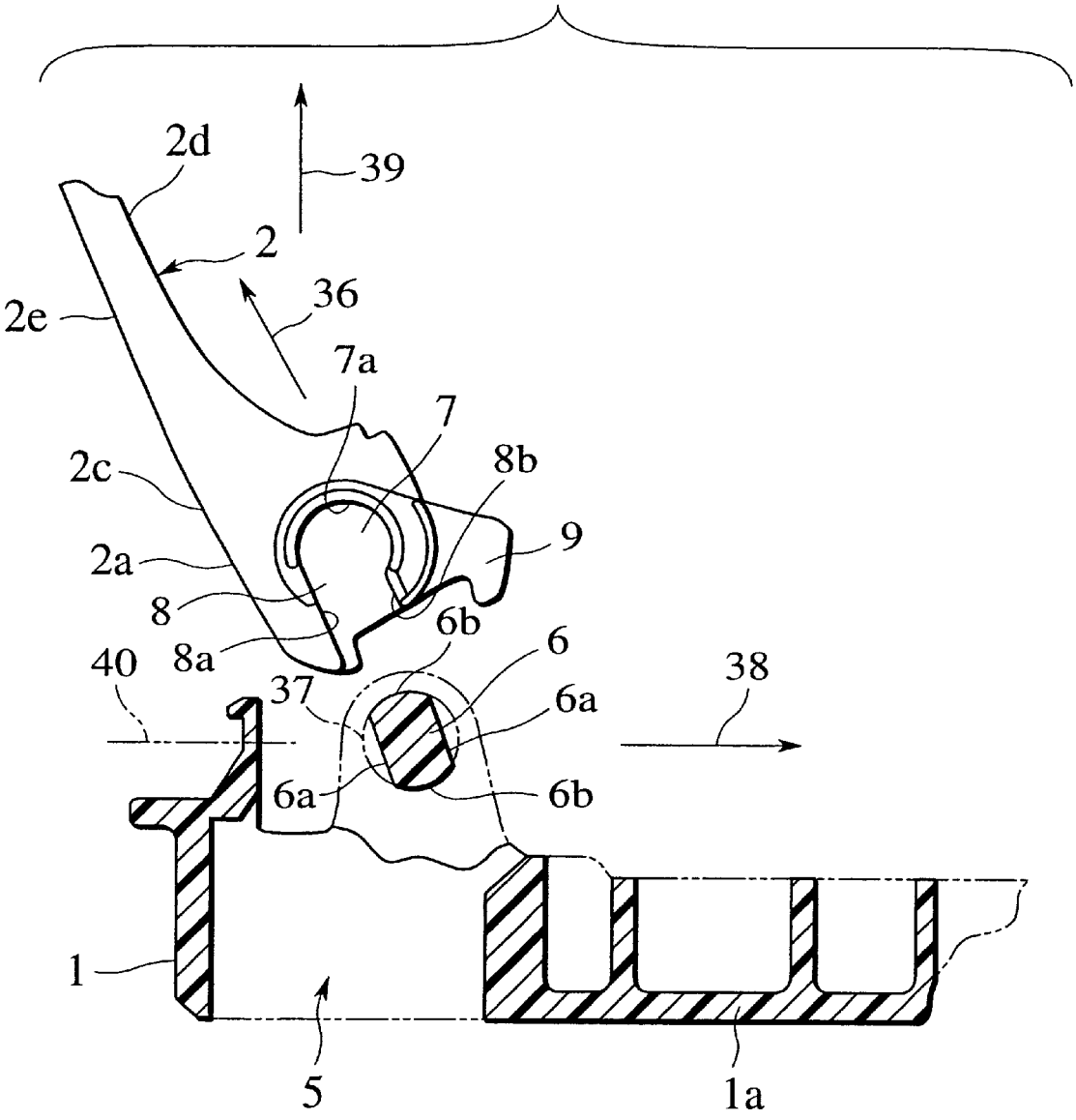
FIG. 6 is a sectional view, taken along a line 34—34 in FIG. 2, showing the car inside handle unit structure positioned in a state where a handle is removed.

As shown in FIG. 6, the flat surfaces 6*a*, 6*a* of the boss axis 6 are tilted from the vertical direction 39 of the base plate 2*a* to the side which is opposite to the extending direction 38 of the operating portion 2*d* positioned in the latching position P1. In other words, the flat surfaces 6*a*, 6*a* are tilted relative to a center line 40 of the groove 8 in the latching position P1 such that the releasing direction 36 of the handle 2 in the releasing position P3 is positioned on the opposite side to the operating portion 2*d* positioned in the latching position P1. Therefore, as shown in FIG. 7, contact areas (overlapping lengths) between the circular arc surfaces 6*b*, 6*b* of the boss axis 6 in the unlatching position P2 and the partial inner peripheral surface 7*a* of the bearing hole 7 can be increased. In this embodiment of the present invention, each of the contact areas between the circular arc surfaces 6*b*, 6*b* of the boss axis 6 in the unlatching position P2 and the partial inner peripheral surface 7*a* of the bearing hole 7 is set to exceed half (50%) of a total area of the partial inner peripheral surface 7*a*.

A projected portion 9 which extends in the radius-of-rotation direction of the handle 2 is provided to the upper end wall 2*a* of the handle 2. A protruded portion 10 which can engage with a lower surface 9*a* of the projected portion 9 in the unlatching position P2 is provided to the handle receiving portion 5 of the base 1.

The inner surface 8*a* of the groove 8 which is positioned in the vicinity of an outer surface 2*e* of the handle 2 extends along the tangential direction of the partial inner peripheral surface 7*a* of the bearing hole 7.

Figure 9:
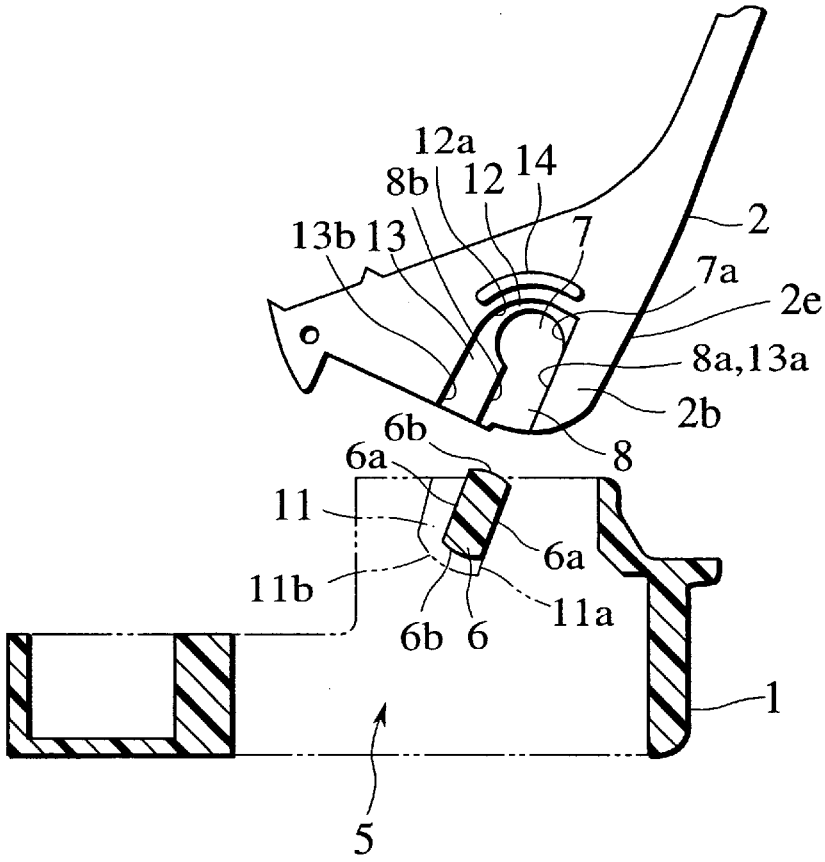
FIG. 9 is a sectional view, taken along a line 35—35 in FIG. 2, showing the car inside handle unit structure positioned in a releasing position.

As shown in FIGS. 1 and 9, a second boss axis 11 having a second circular arc surface 11*b* is provided near a base end of the boss axis 6 which is formed in the lower wall 5*b* of the handle receiving portion 5. The second circular arc surface 11*b* has a larger radius of curvature than the circular arc surface 6*b* of the boss axis 6. A second bearing hole 12 and a second groove 13 which correspond to a second boss axis 11 are formed in the lower end wall 2*b* of the handle 2. The second groove 13 extends from the second bearing hole 12 to open the second bearing hole 12. The second bearing hole 12 is partitioned by a partial inner peripheral surface 12*a* having a radius of curvature which is substantially equal to that of the second circular arc surface 11*b*. The second groove 13 is partitioned by a pair of second inner surfaces 13*a*, 13*b* which are opposed to each other.

Figure 10:
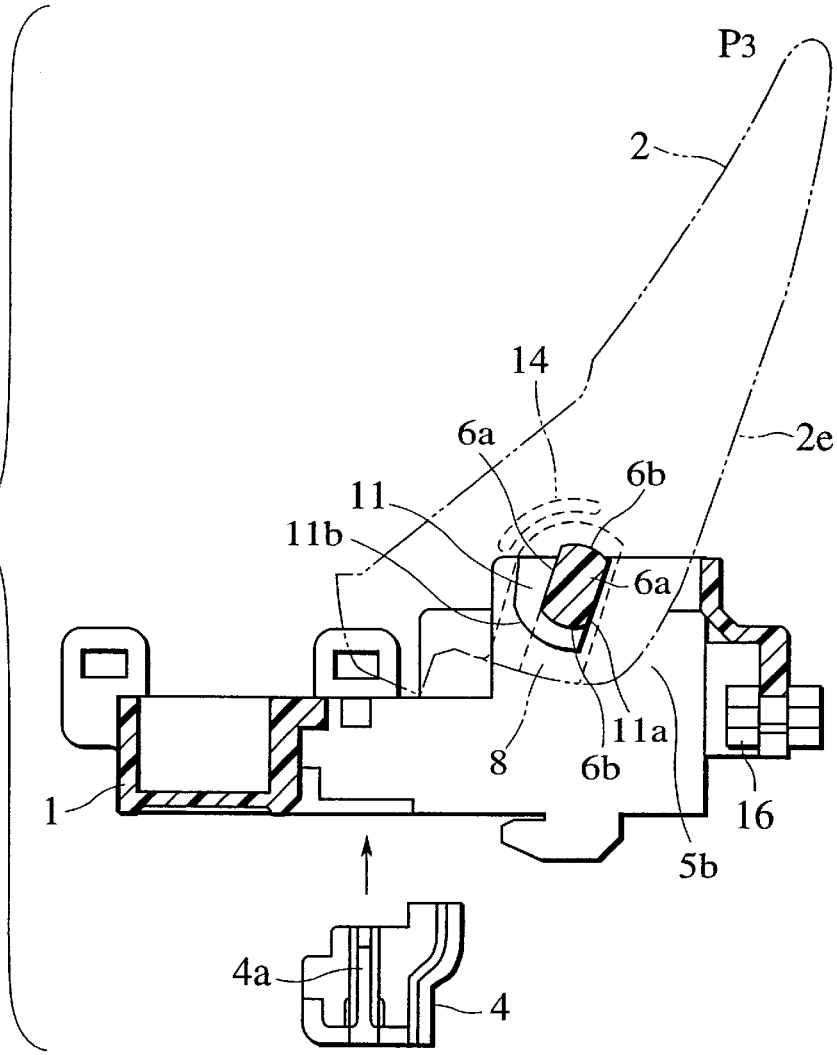
FIG. 10 is a sectional view, taken along the line 35—35 in FIG. 2, showing the car inside handle unit structure positioned in the releasing position.

As shown in FIG. 9, the second inner surface 13*a* which is formed in the vicinity of the outer surface 2*e* of the handle 2 is formed coplanarly with the inner surface 8*a* of the groove 8. As shown in FIG. 10, the second boss axis 11 opposes to the second inner surface 13*a*, and has a side wall 11*a* which is formed coplanarly with the flat surface 6*a* of the boss axis 6.

An almost circular arc rib 14 which protrudes toward the lower wall 5*b* of the base 1 is provided to the lower end wall 2*b* of the handle 2. Since the rib 14 can come into contact with the lower wall 5*b*, play of the handle 2 can be suppressed in turning the handle 2.

As shown in FIGS. 6 and 9, when the handle 2 is fitted to the base 1, the stopper 4 is unlatched from the base 1 and then the handle 2 is shifted toward the base 1 such that the boss axis 6 can be moved relatively along the groove 8. At this time, the second boss axis 11 is moved relatively in the second groove 13. Accordingly, the boss axis 6 is inserted into the bearing hole 7 and also the second boss axis 11 is inserted into the second bearing hole 12. As a result, the handle 2 can come to the releasing position P3 (see FIG. 10) and thus it can be rotated upon the boss axis 6. Then, the handle 2 is shifted from the releasing position P3 to the latching position P1 and then the stopper 4 is fitted onto the base 1. Accordingly, the handle 2 can be shifted between the latching position P1 and the unlatching position P2. Between the latching position P1 and the unlatching position P2, the partial inner peripheral surface 7*a* of the bearing hole 7 comes into contact with both the circular arc surfaces 6*b*, 6*b* of the boss axis 6 and is supported by them, and also the partial inner peripheral surface 12*a* of the second bearing hole 12 comes into contact with the second circular arc surface 11*b* of the second boss axis 11 and is supported by it.

Figure 11:
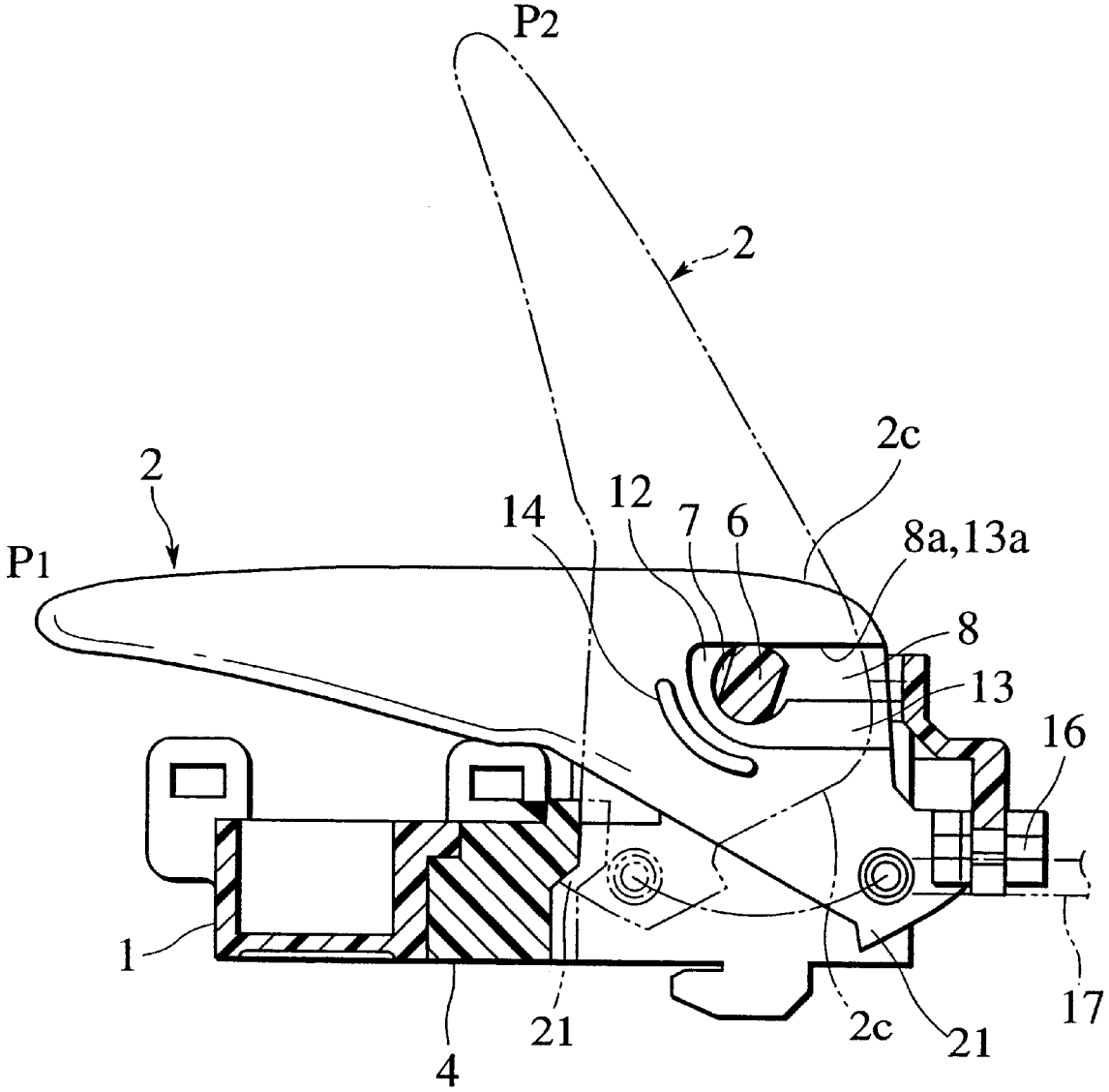
FIG. 11 is a sectional view, taken along the line 35—35 in FIG. 2, showing the car inside handle unit structure positioned in the latching position.

A lock knob 15 in FIG. 1 and a bumper rubber 16 in FIG. 11 are fitted to the base 1. The bumper rubber 16 can contact the handle 2 to absorb the impact when the handle 2 is turned to the unlatching position P2 and then put back by the coil spring 3.

One end of a rod 17 in FIG. 11 is coupled to an end portion of the coupling portion 2*c* of the handle 2, and the other end of the rod 17 is coupled to a locking device (not shown). The rod 17 transmits an operation of the handle 2 to the locking device.

Figure 5:
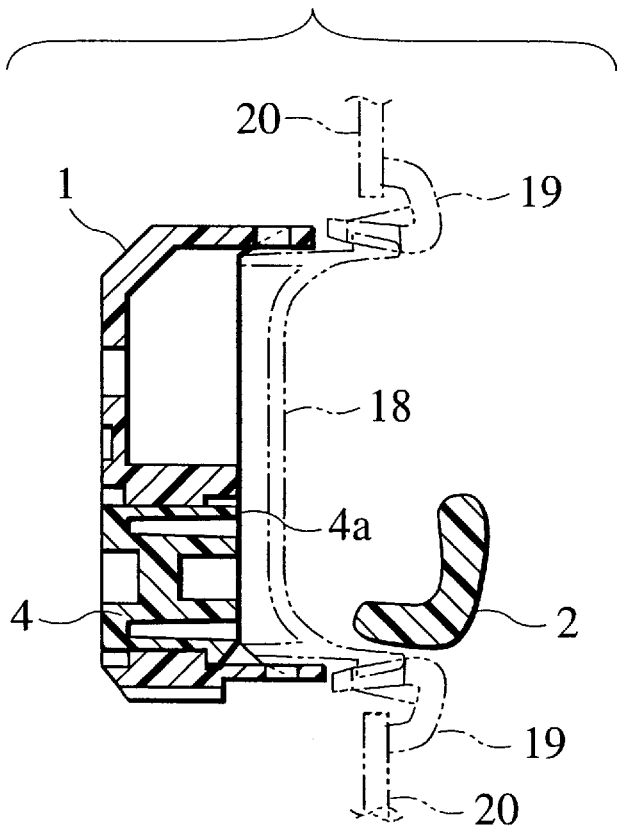
FIG. 5 is a sectional view, taken along a line 33—33 in FIG. 2, showing the car inside handle unit structure positioned in a latching position.

A cover 18 in FIG. 5 is secured to the base 1 to cover the inside of the base 1. An escutcheon 19 is attached to the base 1 to conceal a clearance between the cover 18 and a door trim 20.

As described above, in the present embodiment, the flat surfaces 6*a*, 6*a* are tilted relative to the center line 40 of the groove 8 positioned in the latching position P1 such that the releasing direction 36 of the handle 2 in the releasing position P3 can be positioned on the opposite side of the operating portion 2*d* positioned in the latching position P1. For this reason, the contact areas (overlapping lengths) between the circular arc surfaces 6*b*, 6*b* of the boss axis 6 in the unlatching position P2 and the partial inner peripheral surface 7*a* of the bearing hole 7 can be increased. Therefore, a surface pressure applied to the boss axis 6 of the base 1 can be reduced in the unlatching position P2 and thus the handle supporting strength can be improved.

The projected portion 9 which can engage with the upper wall 5*a* in the unlatching position P2 is provided to the upper end wall 2*a* of the handle 2. For this reason, when the downward load is applied to the handle 2 in the unlatching position P2, the projected portion 9 engages with the upper wall 5*a* and is supported by it. Therefore, a downward inclination supporting strength in the axial direction of the handle 2 can be enhanced.

The protruded portion 10 which can engage with the lower surface 9*a* of the projected portion 9 in the unlatching position P2 is provided to the handle receiving portion 5 of the base 1. For this reason, when the upward load is applied to the handle 2 in the unlatching position P2, the protruded portion 10 engages with the lower surface 9*a* of the projected portion 9 and is supported by it. Therefore, an upward inclination supporting strength in the axial direction of the handle 2 can be enhanced.

The inner surface 8*a* of the groove 8 is formed on the tangent of the partial inner peripheral surface 7*a* of the bearing hole 7. For this reason, a thickness of the outer surface 2*e* side of the handle 2 can be suppressed to the lowest minimum, so that a clearance between the handle 2 and the base 1 can be reduced to the lowest minimum in fitting the handle 2. Therefore, the escutcheon 19 which is attached onto the outer periphery of the base after assembly can be reduced in size and also appearance after assembly can be improved.

Figure 3:
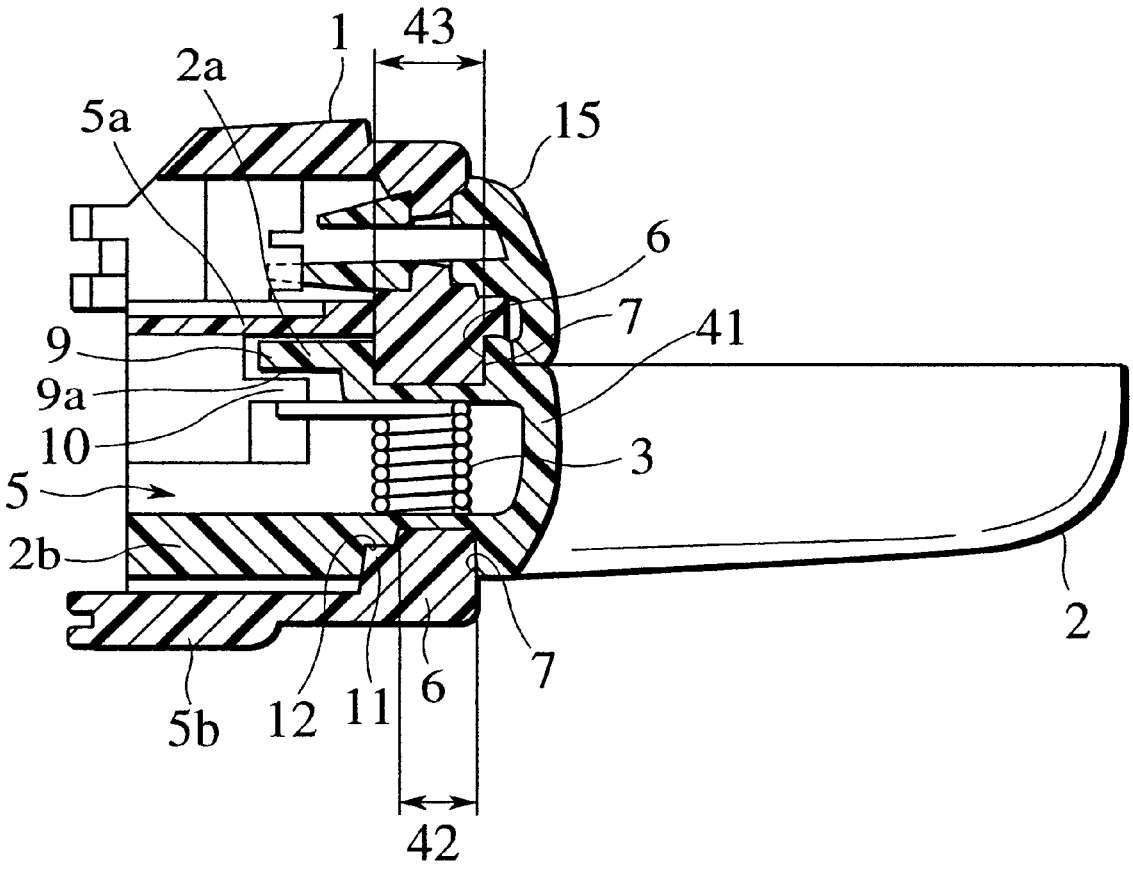
FIG. 3 is a sectional view, taken along a line 31—31 in FIG. 2, showing the car inside handle unit structure positioned in an unlatching position.
Figure 4:
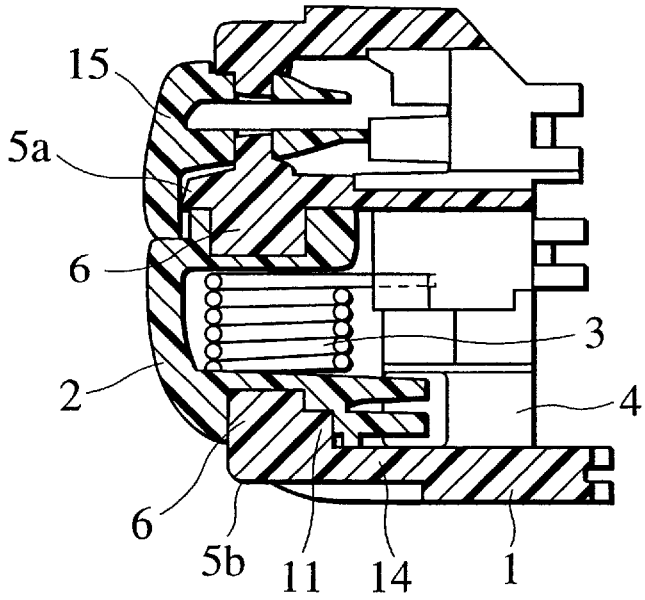
FIG. 4 is a sectional view, taken along a line 32—32 in FIG. 2, showing the car inside handle unit structure positioned in a latching position.

As shown in FIG. 3, a coupling wall 41 between the upper end wall 2*a* and the lower end wall 2*b* of the handle 2 becomes close to the base 1 as it comes up to the lower end wall 2*b*. For this reason, a size of the bearing hole 7 on the lower end wall 2*b* is limited, so that a diameter 42 of the boss axis 6 in the lower wall 5*b* becomes smaller than a diameter 43 of the boss axis 6 in the upper wall 5*a*. On the other hand, the second boss axis 11 is provided near the base end of the boss axis 6 in the lower wall 5*b*, and also the second bearing hole 12 into which the second boss axis 11 is inserted is provided to the lower end wall 2*b* of the handle 2. Therefore, even if the diameter 42 of the boss axis 6 in the lower wall 5*b* is formed smaller than the diameter 43 of the boss axis 6 in the upper wall 5*a*, the partial inner peripheral surface 12*a* of the second bearing hole 12 can come into contact with the second circular arc surface 11*b* of the second boss axis 11 between the latching position P1 and the unlatching position P2 and can be supported by it. Hence, stress concentration caused in turning the handle 2 can be relaxed and thus a strength in the rotation direction can be improved.

The second inner surface 13*a* of the second groove 13 which is formed in the vicinity of the outer surface 2*e* of the handle 2 is formed coplanarly with the inner surface 8*a* of the groove 8, and also the second boss axis 11 opposes to the second inner surface 13*a* and has the side wall 11*a* which is formed coplanarly with the flat surface 6*a* of the boss axis 6. For this reason, the thickness of the outer surface 2*e* side of the handle 2 can be suppressed to the lowest minimum, so that the clearance between the handle 2 and the base 1 can be reduced to the lowest minimum in fitting the handle 2. Therefore, even if the second boss axis 11 is formed, a size of the escutcheon 19 can be reduced and also appearance after assembly can be improved.

What is claimed is:

1. A car inside handle unit structure comprising:

a handle having a coupling portion and an operating portion extended from the coupling portion, the coupling portion having a pair of opposing end walls each of which has a bearing hole and a groove, and the groove extending from the bearing hole in a direction opposite to the operating portion to open the bearing hole;

a base adapted to be fixed to a car body, the base having a base plate and a pair of supporting walls which project from the base plate to oppose to each other;

a pair of boss axes each of which is inserted into the bearing hole, the boss axes projecting from the supporting walls opposedly to support the handle rotatably from a releasing position to a latching position via an unlatching position, the operating portion being positioned in substantially parallel with the base plate in the latching position and standing upright in the base plate in the unlatching position, each of the boss axes having an outer peripheral surface consisting of a pair of flat surfaces positioned in parallel and circular arc surfaces formed between the flat surfaces, both the circular arc surfaces come into contact with a partial inner peripheral surface between the latching position and the unlatching positions only one of the circular arc surfaces comes into contact with the partial inner peripheral surface of the bearing hole and also the flat surfaces allows the boss axis to pass through the groove when the handle is positioned in the releasing position, the boss axis being inserted/ pulled out into/from the bearing hole through the groove, and the flat surfaces being tilted from a vertical direction of the base plate to a side which is opposite to an extending direction of the operating portion positioned in the latching position;

an energizing member positioned to expand between the base and the handle, the energizing member energizing the handle toward the latching position; and a stopper fitted to the base attachably/detachably, the stopper preventing the handle from turning to the releasing position via the unlatching position.

2. The car inside handle unit structure of claim 1, wherein at least one of the end walls has a projected portion which comes into contact with at least one of the supporting walls when the handle is positioned in the unlatching position.

3. The car inside handle unit structure of claim 1, wherein one of the end walls has a projected portion which comes into contact with one of the supporting walls when the handle is positioned in the unlatching position, and other of the end walls has a protruded portion which comes into contact with other of the supporting walls when the handle is positioned in the unlatching position.

4. The car inside handle unit structure of claim 1, wherein the handle has an outer surface which is exposed in the latching position, each of the grooves is partitioned by a pair of inner surfaces which are opposed to each other, and one of the inner surfaces, which is positioned in vicinity of the outer surface, extends along a tangential direction of the partial inner peripheral surface of the bearing hole.

5. The car inside handle unit structure of claim 1, wherein one of the supporting walls has a second boss axis, the second boss axis is formed near a base end of the boss axis and has a second circular arc surface which has a radius of curvature larger than the circular arc surfaces of the boss axis, one of the supporting walls has a second bearing hole which corresponds to the second boss axis, and the second circular arc surface comes into contact with a partial inner peripheral surface of the second bearing hole when the handle is positioned in the unlatching position.

6. The car inside handle unit structure of claim 5, wherein the handle has an outer surface which is exposed in the latching position, each of the grooves is partitioned by a pair of inner surfaces which are opposed to each other, one of the end walls has a second groove to open the second bearing hole, the second boss axis is fitted into the second bearing hole via the second groove when the boss axis is inserted into the bearing hole via the groove, the second groove is partitioned by a pair of second inner surfaces which are opposed to each other, one of the second inner surfaces, which is positioned in vicinity of the outer surface, is formed coplanarly with one of the inner surfaces, which is positioned in vicinity of the outer surface, and the second boss axis has a side surface which corresponds to one of the second inner surfaces and is formed coplanarly with one of the flat surfaces of the boss axis.

7. The car inside handle unit structure of claim 1, wherein the flat surfaces are tilted from a vertical direction of the base plate to a side which is opposite to an extending direction of the operating portion in the latching position, whereby contact lengths between the circular arc surfaces of the boss axis in the unlatching position and the partial inner peripheral surface of the bearing hole can be increased.

8. The car inside handle unit structure of claim 1, wherein the base has a handle receiving portion with the supporting walls, and at least a part of the coupling portion is received in the handle receiving portion.

9. The car inside handle unit structure of claim 1, wherein the energizing member is composed of a coil spring.

10. The car inside handle unit structure of claim 1, wherein the contact areas between the circular arc surfaces of the boss axis and the partial inner peripheral surface of the bearing hole exceed half of a total area of the partial inner peripheral surface when the handle is positioned in the unlatching position.

11. The car inside handle unit structure of claim 1, wherein each of the grooves is partitioned by a pair of inner surfaces which are opposed in parallel to each other, and a distance between the flat surfaces of the boss axes is slightly larger than a distance between the inner surfaces.

12. A car inside handle unit structure comprising:

a base fixed to a car body, the base having a pair of boss axes;

a handle being rotated upon the boss axes, one end of the handle being supported to the base via the boss axes to be rotated between a latching position and an unlatching position, the handle being positioned in substantially parallel with the base plate in the latching position and also standing upright in the base in the unlatching position;

an energizing member positioned to expand between the base and the handle, the energizing member energizing the handle toward the latching position; and a stopper fitted to the base attachably/detachably, the stopper preventing the handle from turning to the releasing position via the unlatching position;

wherein the base has a handle receiving portion with a pair of supporting walls, the handle receiving portion receives the one end of the handle, the boss axes project from the supporting walls to oppose to each other, and each of the boss axes has an outer peripheral surface consisting of a pair of flat surfaces positioned in parallel and circular arc surfaces formed to connect the flat surfaces, the handle has a pair of end walls positioned at the one end, each of the end walls has a bearing hole which engages with the boss axis and a groove through which the boss axis is inserted/pulled out into/from the bearing hole, the groove extends from the bearing hole to a side opposite to other end of the handle to open the bearing hole, and the flat surfaces are tilted relative to a center line of the groove in the latching position such that the releasing direction of the handle in the releasing position is positioned on an opposite side to other end of the handle in the latching position, whereby contact lengths between the partial inner peripheral surface of the bearing hole and the circular arc surfaces of the boss axis in the unlatching position can be increased.

* * * * *